US006785498B2

(12) United States Patent
Manno

(10) Patent No.: US 6,785,498 B2
(45) Date of Patent: Aug. 31, 2004

(54) DEVELOPMENT SYSTEM FOR DEVELOPING AN IMAGE ON AN IMAGE BEARING MEMBER

(75) Inventor: Eugene J. Manno, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/322,010

(22) Filed: Dec. 17, 2002

(65) Prior Publication Data

US 2004/0114969 A1 Jun. 17, 2004

(51) Int. Cl.[7] ..... G03G 15/09

(52) U.S. Cl. ..... 399/267; 399/272; 399/273; 399/277

(58) Field of Search ..... 399/267, 270, 399/271–277

(56) References Cited

U.S. PATENT DOCUMENTS

| | | | | |
|---|---|---|---|---|
| 4,638,759 A | * | 1/1987 | Ville et al. | 399/276 |
| 4,816,870 A | * | 3/1989 | Nagayama | 399/267 |
| 5,296,905 A | * | 3/1994 | Yousey et al. | 399/356 |
| 5,409,791 A | | 4/1995 | Kaukeinen et al. | 430/54 |
| 5,752,139 A | * | 5/1998 | Sumikawa et al. | 399/273 X |
| 5,946,534 A | | 8/1999 | Lewis | 399/272 |

* cited by examiner

*Primary Examiner*—William J. Royer

(57) ABSTRACT

A development system optimized for efficient development of an electrostatic latent image on an imaging surface. The development system includes a development material sump, a magnetic developer roll including a rotatable sleeve having located therein a rotatable magnetic core, and a developer material delivery system for providing a metered supply of developer material to the rotatable sleeve. One or more stationary magnetic shunts are located with respect to the magnetic core, sleeve, and/or developer material delivery system so as to block the magnetic field effective for attracting developer material to the sleeve, thus allowing disengagement of the developer material therefrom at a drop-off zone.

20 Claims, 3 Drawing Sheets

DEVELOPMENT SYSTEM FOR DEVELOPING AN IMAGE ON AN IMAGE BEARING MEMBER

This invention relates generally to an electrophotographic printing machine and, more particularly, to a development system for development of electrostatic images.

An electrophotographic printing machine includes a photoconductive member which is charged to a substantially uniform potential to sensitize the surface thereof. The charged portion of the photoconductive member is exposed to an optical light pattern representing a document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired image-wise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies.

In the prior art, both interactive and non-interactive development have been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to improve developer adhesion. The rotation of the sleeve transports magnetically adhered developer through a development zone where there is direct contact between the magnetic brush and the imaged surface, and toner is stripped from the passing magnetic brush filaments by the electrostatic fields of the image.

U.S. Pat. No. 5,409,791 to Kaukeinen et al., the disclosure of which is hereby incorporated by reference, describes a non-interactive magnetic brush development method employing permanently magnetized carrier beads operating with a rotating multipole magnet within a conductive and nonmagnetic sleeve. Magnetic field lines form arches in the space above the sleeve surface and form chains of carrier beads. The developer chains are held in contact with the sleeve and out of direct contact with a photoreceptor by gradients provided by the multipole magnet. As the magnet rotates in one direction relative to the sleeve, the magnetic field lines beyond the sleeve surface rotate in the opposite sense, moving carrier bead chains in a tumbling action which transports developer material along the sleeve surface. The strong mechanical agitation effectively dislodges toner particles generating a rich powder cloud which can be developed to the adjacent photoreceptor surface under the influence of development fields between the sleeve and the electrostatic image. However, such radial flow of developer material occurs over the full surface of the sleeve; hence, a stripping device such as a skiving blade must be included for removing spent developer before it returns to the development zone.

In conceiving the present invention, I have found that the conventional approach to construction and operation of a development system, and especially the above-described development system, suffer from the following undesirable phenomena.

Firstly, the magnetic brush development configuration disclosed in Kaukeinen et al. does not lend itself readlly to the construction and operation of a development system located laterally (at what is known as a "three o'clock" or a "nine o'clock" position) with respect to a vertically-oriented photoreceptor surface.

Secondly, as illustrated in FIG. 1, it may be observed that the provision of agitated bead chains according to at least one of the foregoing approaches will result in linear ridges, or "piles", of developer material distributed about a developer sleeve 100 due to the high density of bead chains approximately at the midpoint of each magnet 120. (Corresponding valleys, or "troughs", of developer material thus locate at the intersections of adjacent magnets 120.) As a consequence of this effect, the resulting developer chains accumulate over the developer roll in linear piles having varying peaks and troughs that are arranged in parallel to the central longitudinal axis of the magnetic developer roll.

In typical practice, the magnetic developer roll is operated with associated devices, such as a skiving blade, that engage the developer sleeve 100 in order to remove unused developer and toner material from the developer sleeve 100. Similar devices may be located adjacent the developer sleeve to meter fresh developer material onto the developer sleeve 100 so as to effect replenishment of fresh developer material. In typical practice, such blades are oriented in parallel with the same central longitudinal axis of the magnetic developer roll.

In conceiving the present invention, I have found that the above-described development systems suffer from the following undesirable phenomena.

The magnetic brush height formed by the developer mass in the magnetic fields on the sleeve surface in the aforementioned types of development systems is periodic in thickness and is statistically noisy as a result of complex carrier bead agglomeration and filament exchange mechanisms that occur during operation. Accordingly, substantial clearance must be provided in the development gap to avoid photoreceptor interactions through direct physical contact. The use of a closely spaced developer layer, which is critical to high fidelity image development, is precluded.

The magnetic pole spacing cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the layer of developer material on the sleeve. Since the internal pole geometry defining the spatial wavelength of the tumbling component also governs the magnitude of the holding forces for the developer material at any given range, there is limited design freedom available to satisfy the opposing system requirements of short spatial wavelength and strong holding force.

Relative rotation of the magnetic developer roll and the developer sleeve will rotate successive ones of the magnets within the developer sleeve and thus under the engaging edge of the skiving blade. A corresponding movement of successive linear piles of developer material move along the exterior of the developer sleeve. As a result, the skiving blade will periodically be impacted by the entire length of a linear pile of developer material, whereupon the development system undergoes substantial increase in mechanical stress, which is periodic due to the rapid succession of developer pile masses encountered by the skiving blade. During each stress peak, the skiving blade, magnetic developer roll, developer material, along with the motor drive and any respective mechanisms including motor drive bearings, will experience a significant increase in mechanical force. The motor drive also undergoes a significant peak demand for drive torque. Additional undesirable effects include a likelihood of vibration in the system, an increase in imaging artifacts due to motion disturbances, degradation of the carrier and toner (presumably due to the pile/blade impact), and a propensity for temporal and spatial variations in the efficiency of the skiving blade. Such a skiving blade can become contaminated and thus falter, and developer additives are required to keep it clean. Such skiving action can also abrade both the skiving blade and the developer sleeve. This magnetic developer roll can also become impractical when constructing a wide body configuration (e.g., a roll length that exceeds approximately 17 inches), as the aforementioned mechanical stress can be expected to increase dramatically as the magnetic developer roll increases in length.

The present invention obviates the problems noted above by providing a development system that employs a magnetic developer roll featuring a magnetic core operable for relative rotation within a developer sleeve. The magnetic core includes a plurality of magnetic core pole segments that are tightly arranged on the magnetic core in an alternating pole pattern. The development system is constructed such that orientation of the magnetic developer roll to a vertically oriented photosensitive medium such as a photoconductor belt or drum may be laterally positioned with respect to the vertically oriented photosensitive medium. Accordingly, and in a principal feature of the invention, the magnetic field gradient of the magnetic core is blocked by use of magnetic shunts located about the magnetic core such that certain corresponding portions of the developer material layer most proximate to the magnetic shunts are released from the developer sleeve and fall under the influence of gravity into a developer material sump for recirculation in the developer material sump.

The contemplated development system is thus optimized for provision of a development zone locatable at a three o'clock or nine o'clock position with respect to a photoconductor belt. The development system includes a developer material sump, a magnetic developer roll having a rotatable sleeve enclosing a magnetic core, and a developer material delivery system including a mixing assembly and a developer material metering device for providing a metered supply of developer material from the developer material sump to the sleeve. The developer material is moved from the mixing assembly and into the metering device and for aiding transport of the developer material to the sleeve. In a preferred embodiment, developer material is provided to the sleeve from a metering slot and the developer material dispensed from the slot is attracted to the sleeve due to the magnetic field provided by the magnetic core.

A slot located within the metering device and proximate to the loading zone thereby forms a thin, pre-defined layer of developer material on the sleeve exterior surface. The magnetic core in the rotating developer roll generates a magnetic field to move the layer of developer material along the sleeve exterior surface to the development zone, where a portion of the layer is agitated, that is, the portion of the layer of developer material proximate to the magnetic core and thereby subject to the magnetic field gradient of the magnetic core. The toner particles are dislodged from the carrier beads to aid in the formation of a toner cloud in the development zone. Continued rotation of the sleeve brings the layer of developer material to a drop-off zone adjacent the shunts where the magnetic field has declined sufficiently to allow the developer material to fall from the sleeve into the sump.

Accordingly, the magnetic developer roll may be optimized for a particular developer layer height and agitation, for more efficient development of a latent image. Additional benefits include: extended operating latitudes, improved development efficiency, and improved mixing of developer material.

Furthermore, a developer material stripping device is no longer necessary, because spent developer material falls from the sleeve at the drop-off zone. The contemplated development system thereby experiences a smoother rotational operation, and a significant reduction in the mechanical forces and stresses described above, along with a concomitant reduction in vibration, imaging artifacts, carrier and toner degradation, and other deficiencies in the performance of the system.

Thus, a development system constructed according to this invention is not only compact and robust but also permits use of less costly components, such as a compact magnetic core, and a motor drive of lower drive torque.

An apparatus for non-interactive development of electrostatic images may be constructed to include an image bearing member bearing an electrostatic image; two-component developer material comprising toner and hard magnetic (permanently-magnetized) carrier beads, a magnetic developer roll, a rotatable magnetic core having multiple pole segments, and a cylindrical developer transporting sleeve enclosing and rotating about the rotatable magnetic core.

In a particular feature of the present invention, the sleeve exhibits a uniform, predefined sleeve radius and the magnetic core is located within the sleeve with at least a first magnetic shunt being located between the magnetic core and the sleeve, and a second magnetic shunt being located between the exterior of the sleeve and proximate portions of the mixing assembly. Accordingly, the magnetic core is optimally located for agitating a portion of the developer layer of the two component developer material, the agitated portion being spaced close to but not contacting with the image bearing member. Thus, the developer layer is transported about the sleeve from a loading zone, to and within the development zone, where it is advantageously subject to agitation induced by the field gradients provided by the magnetic core, and therefrom to a drop-off zone.

In another feature of the present invention, the layer of developer material will progress from the loading zone through the development zone to a drop-off zone. This feature is useful in constructing a development system according to the present invention for a "wide-body" reprographic system design which have photosensitive members exhibiting as much as 36 inches in width. A development system for such a wide body reprographic system can require, for example, an input of developer material into the development system housing at one side with a subsequent output of developer material at the opposing side of the development system housing.

In another feature of the invention, a development system for developing an image with developer material may be constructed in a more compact unit.

In another feature of the invention, an imaging system for providing image-on-image, non-interactive development of electrostatic images may be constructed to include an image bearing member bearing an electrostatic image; a housing containing developer material, a magnetic developer roll for transporting the developer material from the housing to the image.

Embodiments of the present invention are both robust and permit a spacing between a development system and the electrostatic image that is small enough to eliminate or significantly reduce image defects associated with fine lines and edges.

A detailed description of the exemplary embodiments may now be understood with reference to the Figures. Although the present invention will now be described in connection with one or more embodiments, such description is not intended to be so limited. On the contrary, it is intended to cover all alternatives, modifications, and equivalents as may be included within the spirit and scope of the invention as defined by the appended claims. In the following description, usage of like reference numerals will designate identical elements. The disclosure of U.S. Pat. No. 5,948,534; entitled, "APPARATUS AND METHOD FOR NON-INTERACTIVE ELECTROPHOTOGRAPHIC DEVELOPMENT" is hereby incorporated by reference.

Figure 1:
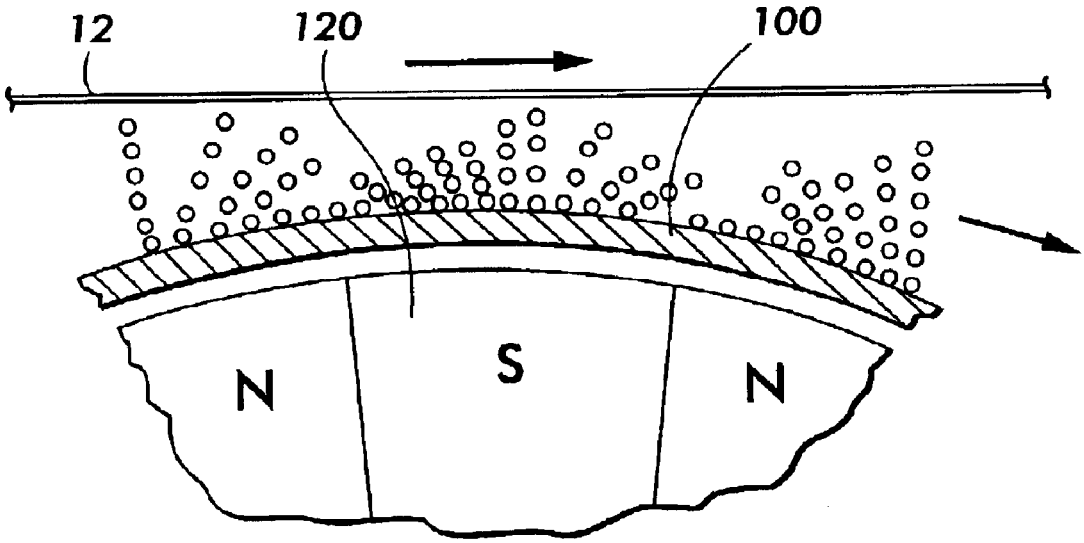
FIG. 1 PRIOR ART
FIG. 1 is a partial side view of a prior art development system.
Figure 2:
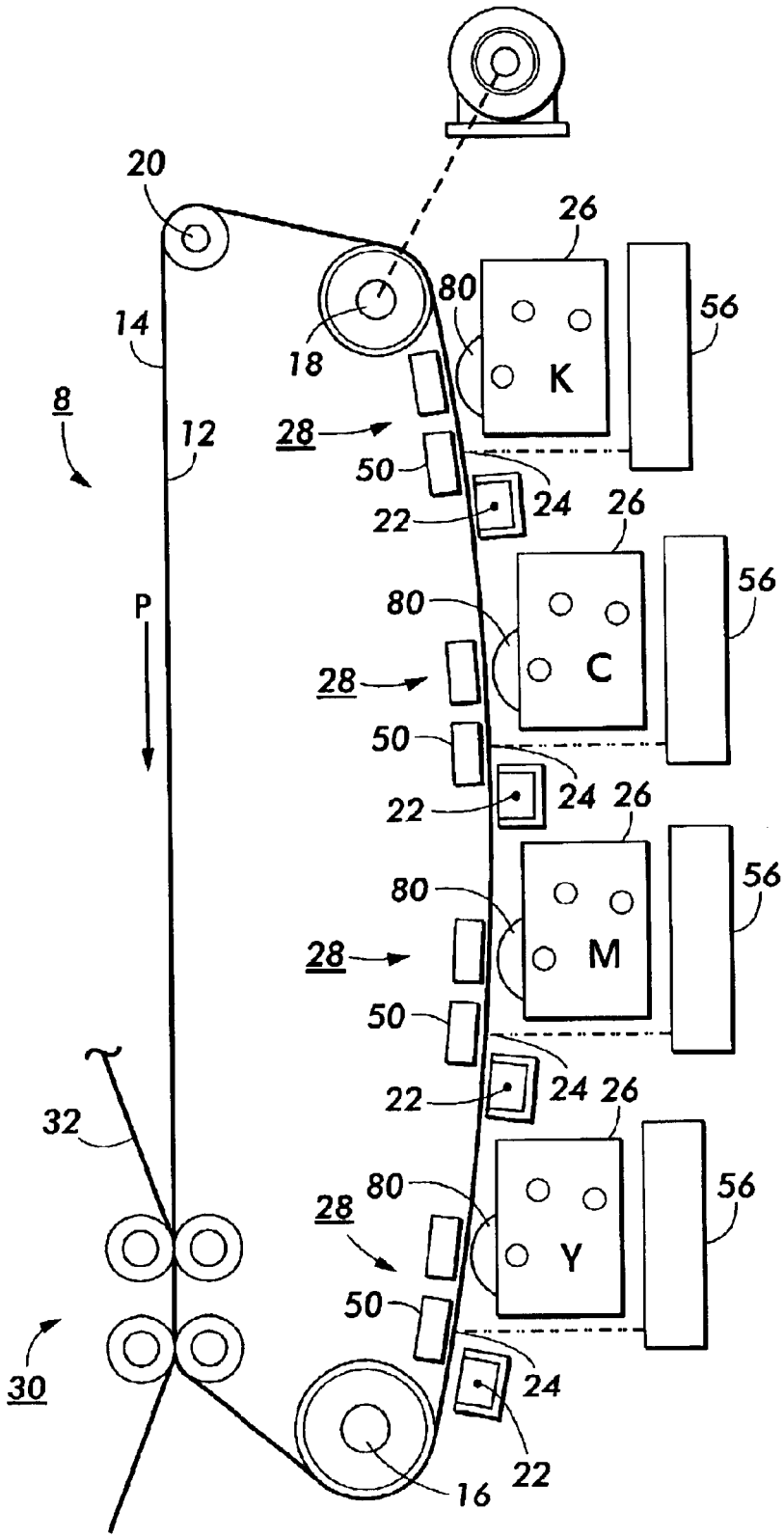
FIG. 2 is a side view, in section, of a four color xerographic reproduction machine incorporating the development system of the present invention.
Figure 3:
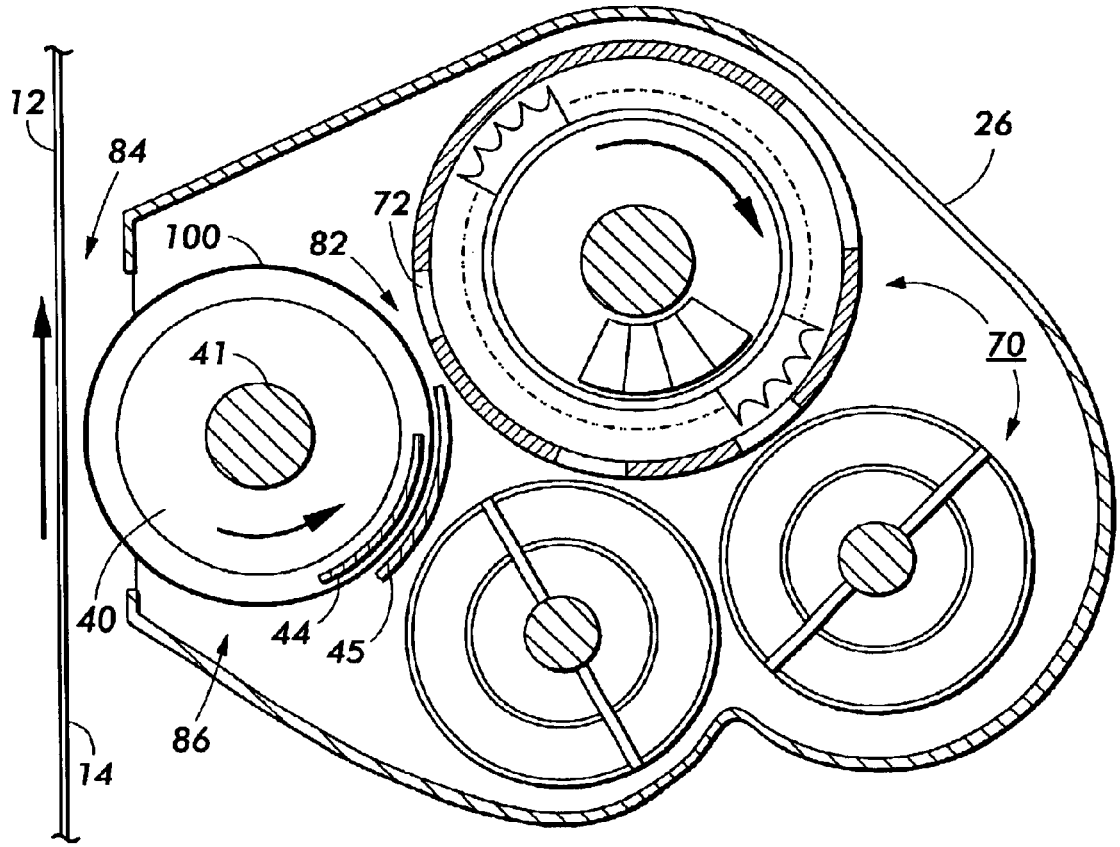
FIG. 3 is an enlarged side sectional view of the system of FIG. 2.

Referring to FIGS. 2 and 3 of the drawings, there is shown a xerographic type reproduction machine 8 incorporating an embodiment of the development system of the present invention that includes a magnetic developer roll designated generally by the numeral 80. Machine 8 has a suitable frame (not shown) on which the machine xerographic components are operatively supported. As will be familiar to those skilled in the art, the machine xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16,18 and 20, and those of transfer station 30, the direction of movement being counter-clockwise as viewed In FIG. 2 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; arid transfer and detack corotrons (not shown) for assisting transfer of the developed image to a suitable copy substrate material such as a copy sheet 32 brought forward in timed relation with the developed image on photoconductive surface 14 at transfer station 30. In preparation for the next imaging cycle, unwanted residual toner is removed from the belt surface at a cleaning station (not shown). Following transfer, the copy sheet 32 is carried forward to a fusing station (not shown) where the toner image is fixed by pressure or thermal fusing methods familiar to those practicing the electrophotographic art. Alter fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A raster output scanner (ROS) 56 generates a closely spaced raster of scan lines on photoconductive surface 14 as photoreceptor 12 advances at a constant velocity over shoe 50. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station.

Developer assembly 26 may include a toner dispensing cartridge (not shown) mounted therein so as to dispense toner particles downward into a sump area therein.

Continuing with the description of operation at each development station 28, the magnetic developer roll 80 is disposed in predetermined lateral operative relation to the photoconductive surface 14 of photoreceptor 12, the length of magnetic developer roll 80 being equal to or slightly greater than the width of photoconductive surface 14, with the central longitudinal axis of magnetic developer roll 80 being parallel to the photoconductive surface 14 and oriented at a "three o'clock" position with respect to the vertical path of photoreceptor 12. Advancement of magnetic developer roll 80 carries the layer of developer material into the development zone in proximal relation with the photoconductive surface 14 of photoreceptor 12 to develop the electrostatic image therein. A suitable controller is provided for operating the various components of machine 8 in predetermined relation with one another to produce full color images containing Y, M, C, K colored toner.

FIG. 3 shows the photoreceptor 12, a rotatable sleeve 100, and a magnet assembly including a magnetic core 40 and stationery magnetic shunts 44 and 45. As shown in FIG. 3, the developer roll 80 is constructed to operate according to a developer material loading zone 82, a development zone 84, and a developer material drop-off zone 88. The stationery magnetic shunts 44 and 45 are positioned so as to block the magnetic fields induced by the core 40 and a developer material delivery system 70, respectively. The gap between the photoconductive surface 14 of photoreceptor 12 and the surface of the sleeve 100 is in the range of about 300 to 800 microns.

The magnetic core 40 preferably includes an array of permanent magnets bonded to a cylindrical core 41 of iron or other soft magnet material. The magnetic core 40 contains regions of alternating magnetic polarization arranged to create a multipole structure. Preferably the density of magnetization is a pure sinusoid with a period of about 6 to 10 mm and the magnetic core 40 has a pole spacing of about 3 to 5 mm.

Sleeve 100 and magnetic core 40 are made to rotate relative to one another by suitable mechanical means. Preferably sleeve 100 is also rotated by these means relative to developer assembly 26. The relative motion of sleeve 100 and magnetic core 40 generate a rotating magnetic drive field (not shown) in a reference frame fixed to the surface of sleeve 100. A supply of developer material layer is passed from a metering slot 72 and attracted to the surface of sleeve 100 under the influence of the magnetic core 40. Rotation of the sleeve 100 transports the developer material layer into and through the development zone 84. A portion of the developer material layer that is proximate to magnetic core 40 is subject to a magnetic field gradient such that advantageous developer material agitation occurs at the development zone 84. Preferably, the developer material layer is prevented from contacting photoconductive surface 14 by the gradient in the magnetic field generated by the magnetic core 40. Improved, non-interactive development of a latent image on the photoconductive surface 14 may be provided in the development zone 84. The developer material layer is then transported to the drop-off zone 86 where the developer material is no longer subject to attraction to the sleeve 100 by virtue of the operation of the stationery magnetic shunts 44 and 45 which are positioned so as to block the magnetic fields induced by the core 40 and the developer material delivery system 70, respectively.

In preferred embodiments, the developer material layer may comprise a thickness in the range of 250 to 500 microns. The developer material layer includes a mixture of magnetic carrier particles, of diameter ranging from 10 to 100 micron, and toner particles, ranging in diameter from 1 to 15 microns.

Preferred examples of the magnetic core 40 are contemplated as containing magnets formed of an extruded magnetic composite material containing at least 80% by volume of neodymium-boron-iron hard magnet alloy. Such extruded magnets are more easily constructed in a keystone shape, and at lower-cost, than may be obtained with conventional sintered hard ferrite magnets, and offer tighter magnetic pole spacing with little or negligible surface discontinuity. Additionally, such magnets may be extruded according to the requisite form factor so as to be exactly shaped without further machining. These magnets may be precisely assembled without gaps to form a magnetic core 40 in a compact cylindrical form that nonetheless offers multiple, very closely-spaced magnetic poles of high magnetic field strength.

The development system described herein is useful for interactive and non-interactive development, depending on whether the toner already on the image may or may not be disturbed or removed by subsequent development procedures.

The terms "reprographic" or "reproduction" apparatus, "printing" or "printer", as used herein, broadly encompasses various printers, copiers, or multifunction machines or systems, electrographic and electrostatographic or otherwise, unless otherwise defined in a claim. The term "sheet" herein refers to a generally planar segment of paper, plastic, or other suitable physical substrate amenable to receiving a developed image, whether precut or web fed.

As to specific components of the subject apparatus or methods, or alternatives therefor, it will be appreciated that such components are optional if so designated, and if such components are known per se in other apparatus or applications, other versions may be additionally or alternatively used, especially those from prior art cited herein. All references cited in this specification, and their references, are incorporated by reference herein where appropriate for teachings of additional or alternative details, features, and/or technical background.

What is claimed is:

1. A development system for developing an image on an image bearing member with developer material, comprising:

a housing containing the developer material;

a magnetic developer roll for transporting a layer of the developer material from the housing to the image, the magnetic developer roll including a magnetic assembly including a magnetic core and a first stationary magnetic shunt, the magnetic core including a magnetic composite material containing a neodymium-boron-iron alloy, and a sleeve enclosing the magnetic assembly, wherein at least one of the sleeve and magnetic core being rotatable for providing relative rotation and for attracting the layer of the developer material onto the sleeve at a loading zone, for transporting the developer material layer on the magnetic developer roll to a development zone where at least a portion of the developer material layer is advantageously subject to agitation induced by field gradients in a magnetic field provided by the magnetic core, and for transporting the developer material layer further to a drop-off zone where the magnetic field is sufficiently blocked to discontinue the attraction of the developer material to the sleeve.

2. The development system of claim 1, wherein the sleeve exhibits a uniform, predefined sleeve radius and the first stationary magnetic shunt is located substantially between the magnetic core and the sleeve at a position proximate to the drop-off zone.

3. The development system of claim 2, further comprising a developer material sump and a developer material delivery system for delivering developer material from the sump to the magnetic developer roll.

4. The development system of claim 3, further comprising a second magnetic shunt located substantially between the sleeve and the developer material delivery system at a position proximate to the drop-off zone.

5. The development system of claim 1, wherein the agitated portion of the developer material layer is spaced close to and not contacting with the image bearing member.

6. The development system of claim 1, wherein the magnetic core includes a plurality of magnets of alternating polarities arranged with respect to a central longitudinal axis of the magnetic core.

7. The development system of claim 1, wherein the magnetic core includes a magnetic composite material containing at least 60% by volume of neodymium-boron-iron alloy.

8. The development system of claim 1, wherein the developer material further comprises permanently magnetized carrier beads.

9. The development system of claim 1, wherein the magnetic core includes a plurality of magnetic core pole segments.

10. The development system of claim 1, wherein at least a portion of the image bearing member is vertically oriented and the orientation of the magnetic developer roll is laterally positioned with respect to the vertically oriented portion of the image bearing member.

11. The developer system of claim 1, wherein a magnetic field gradient of the magnetic core is blocked at the drop-off zone by the first stationary magnetic shunt so as to discontinue the attraction of the development material to the sleeve.

12. The development system of claim 1, further comprising a metering device operable for forming the layer of developer material on the sleeve.

13. A method for developing an image on an image bearing member with developer material, comprising:

providing a supply of the developer material;

transporting a layer of the developer material on a magnetic developer roll from the supply to the image the magnetic developer roll including a magnetic assembly including a magnetic core and a first stationary magnetic shunt, the magnetic core including a magnetic composite material containing a neodymium-boron-iron alloy, and a sleeve enclosing the magnetic assembly, wherein at least one of the sleeve and magnetic core being rotatable for providing relative rotation and for attracting the layer of the developer material onto the sleeve at a loading zone;

wherein the magnetic developer material layer is transported on the developer roll to a development zone where at least a portion of the developer material layer is advantageously subject to agitation induced by field gradients in a magnetic field provided by the magnetic core, and transported further to a drop-off zone where the magnetic field is sufficiently blocked to discontinue the attraction of the developer material to the sleeve.

14. The method of claim 13, wherein the sleeve exhibits a uniform, predefined sleeve radius and further comprising the step of locating the first stationary magnetic shunt substantially between the magnetic core and the sleeve and proximate to the drop-off zone.

15. The method of claim 13, further comprising the step of providing a developer material sump and a developer material delivery system and wherein the developer material is delivered from the sump to the magnetic developer roll.

16. The method of claim 15, further comprising the step of providing a second magnetic shunt located substantially between the sleeve and the developer material delivery system at a position proximate to the drop-off zone.

17. The method of claim 13, wherein the agitated portion of the developer material layer is provided close to and not contacting with the image bearing member.

18. The method of claim 13, wherein the magnetic core is provided in the form of a plurality of magnets of alternating polarities arranged with respect to a central longitudinal axis of the magnetic core.

19. The method of claim 13, wherein the magnetic core is provided in the form of a magnetic composite material containing at least 60% by volume of neodymium-boron-iron alloy.

20. The method of claim 13, wherein the developer material further comprises permanently magnetized carrier beads.

* * * * *